United States Patent [19]

Carnielli

[11] 3,964,742

[45] June 22, 1976

[54] PHYSIOLOGICAL ACTIVE AND PASSIVE EXERCISING APPARATUS

[76] Inventor: Guido Carnielli, 28, Piazzale Luigi di Savoia, Milan, Italy

[22] Filed: Oct. 16, 1974

[21] Appl. No.: 515,422

[30] Foreign Application Priority Data

Oct. 17, 1974 Italy ..... 30220/74

[52] U.S. Cl. ..... 272/73; 128/25 R

[51] Int. Cl.[2] ..... A63B 21/00

[58] Field of Search ..... 272/73, 79 R, DIG. 3, 272/58; 128/25 R

[56] References Cited

UNITED STATES PATENTS

| | | | |
|---|---|---|---|
| 2,107,447 | 2/1938 | Marlowe | 272/73 |
| 3,572,699 | 3/1971 | Nies | 272/73 |
| 3,578,800 | 5/1971 | Dinepi | 272/73 |
| 3,727,913 | 4/1973 | Glaser et al. | 272/73 |

*Primary Examiner*—Richard E. Pinkham
*Assistant Examiner*—William R. Browne
*Attorney, Agent, or Firm*—Michael J. Striker

[57] ABSTRACT

An exercising apparatus has a bicycle-type frame assembly forming a stand for a saddle seat, a rotary crank pedal system, and a rotary crank handle system. The seat and handle systems are independently adjustable in both the vertical and horizontal directions with respect to the crank pedal system. The transmission rotatably connects the crank systems to each other in all adjustable positions, and selectively actuable brakes and a motor permit, respectively, active and passive exercising by a user.

8 Claims, 5 Drawing Figures

PHYSIOLOGICAL ACTIVE AND PASSIVE EXERCISING APPARATUS

BACKGROUND OF THE INVENTION a. The Field of the Invention

This invention is concerned with the art of providing mechanical means such as used by physiotherapists in exercising of patients and disabled persons, more particularly with devices of the kind comprising a frame assembly forming a stand to support a bicycle saddle type seat, rotatable crank and pedal means positioned for being engaged and acted upon by the feet of the person accomodated on said saddle seat, and handle bar means consisting of upper crank and handle means positioned for being engaged and acted upon by the hands of same person, who therefore can perform coordinated rotary and alternated motions with his four limbs for nearly entirely exercising his body.

Such exercizing can be either of active or passive nature. Active exercising is that in which the patient exerts a more or less relevant muscular fatigue in rotating said crank pedals and crank handles against a resistance provided by a suitable braking systems, while passive exercising is that in which the motion of the patient's limbs is promoted or facilitated by rotatively connecting a source of power, such as an electric motor, to said crank pedals and handles so that the limbs of a disabled person are compelled to follow the motions thereof to recover movements coordination for example.

b. The Prior Art

Several exercising apparatuses for producing indoors the movements of cycling have been heretofore proposed, manufactured and widely made use of. A type of such apparatuses has been described in a British Patent. A number of custom-built devices have been designed and constructed to meet specific patients' requirements. Other very complicated and costly devices, which are not generally commercialized, have been constructed and in use in certain orthopaedy and physiotherapy hospitals and clinics.

The heretofore proposed apparatuses are usually suited for the performance of physiological exercises of a given character, and their most severe limitation consists in their poor flexibility, in particular with relation to the adjustment of the device either to different patients and to different positions and body attitude in the exercise. Therefore, the availability of a relatively simple, light weight and portable apparatus, adapted for either home use and general physicians studies, which might be readily adjusted to meet the most various requirements of active and passive exercising of patients of the most varying height and build, the exercising requiring also the most variable attitudes, such as spine bending, is currently considered a long felt want in the art.

It is therefore object of this invention to provide a new and improved apparatus which meets the above and other requirements.

BRIEF SUMMARY OF THE INVENTION

Essentially, the new apparatus comprises a generally bicycle-type frame assembly having a vertical plane of symmetry and forming a stand for supporting a seat, crank pedal means and crank handle means supported for rotation about a horizontal pedal axis and respectively a horizontal handle axis, said seat and axes defining in said plane three stationary but relatively adjustable locations concurring to determine the body attitude of the exerciser, mechanical transmission means for rotatively connecting said crank pedals and crank handles for concurrent and coordinated rotation, said frame assembly including telescopingly and hingedly connected components for either vertical and longitudinal adjustment of the relative positions and spacings between said seat and individual axes, said mechanical transmission means including slip and universal joints meeting said adjustments of relative positions of said axes, and motor means and brake means designed for being alternatively and selectively connected to said transmission means.

These and other objects, features and advantages of the invention will be made apparent as this specification proceeds, when taken in conjunction with the accompanying drawing.

THE SEVERAL VIEWS OF THE DRAWINGS

DETAILED DESCRIPTION OF THE PREFERRED EMBODIMENT

Figure 2:
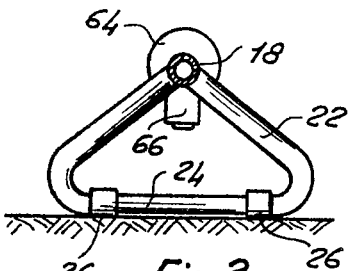
FIGS. 2 and 3 are partial cross-sectional views of same apparatus, taken from the planes and seen in the directions indicated at II—II and respectively at III—III in FIG. 1.
Figure 3:
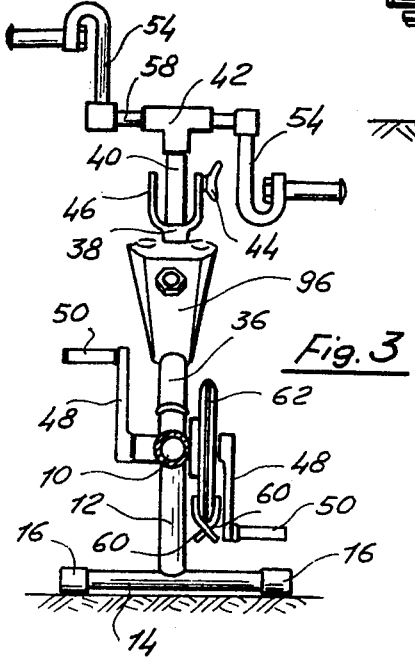

Referring now to the drawings, wherein like numeral characters refer to like components throughout the several FIGURES, there is shown a frame assembly comprising a central body 10 housing a first mechanical subassembly including the axle of bicycle-type pedals consisting of conventional levers 48 and pedals 50. Said body 10 forms a component of the frame and has a front tubular brace 12 and a rear tubular brace 18 secured thereto. The front brace 12 is downwardly bent and it is fixedly connected, such as by welding, to a cross-bar 14 (FIG. 3) provided with resilient blocks or short sleeves 16 fitted about its ends to provide a shock absorbing and non-skidding support of the apparatus on the ground, together with rear resilient blocks 26 (FIGS. 1 and 2) secured to the lower part 24 of a triangular subframe 22 secured to said rear tubular brace 18.

At the rear of and adjacent to said body 10 an upwardly and rearwardly extending saddle post tube a tubular component 20 is fixedly secured to said rear brace 18, in which tube a saddle post or tubular member 28 is telescopingly fitted. Conventional bicycle type clamping means (not shown) are provided for securing at an adjustable height said post 28 in the upper portion of the post tube 20, so that a saddle-type seat 34 can be adjusted in either directions A and B (FIG. 1) to adjust the interval between the seat 34 and the axis about which the pedals 50 rotate. The saddle 34 has secured thereto a saddle frame including horizontal portions 32 which can be secured in any of a plurality of positions so as to be adjustable in either directions C and D on the top of the saddle post 28, by means of clamps 30.

Therefore, the relative position of the seat 34 and of the axis of pedals 50 can be either vertically and horizontally adjusted for adapting the apparatus to the different patient's height and build, and for imparting to the patient's posture the best position for the exercise.

An upwardly and forwardly extending tube or tubular component 36 is secured to the body 10. Such tube 36 forms the lower and stationary portion of a structure which supports the rotary crank handles, which comprise handles 56 secured to the outer ends of crank levers 54, the inner ends of which are keyed or otherwise secured to a handle axle 58 (FIGS. 3 and 4) defining the handle axis. An inner tube or post or tubular member 38 is telescopingly fitted into said stationary tube 36 and it can be secured in various positions of adjustment in either directions E and F, by means of conventional bicycle-type clamp means (not shown).

Figure 1:
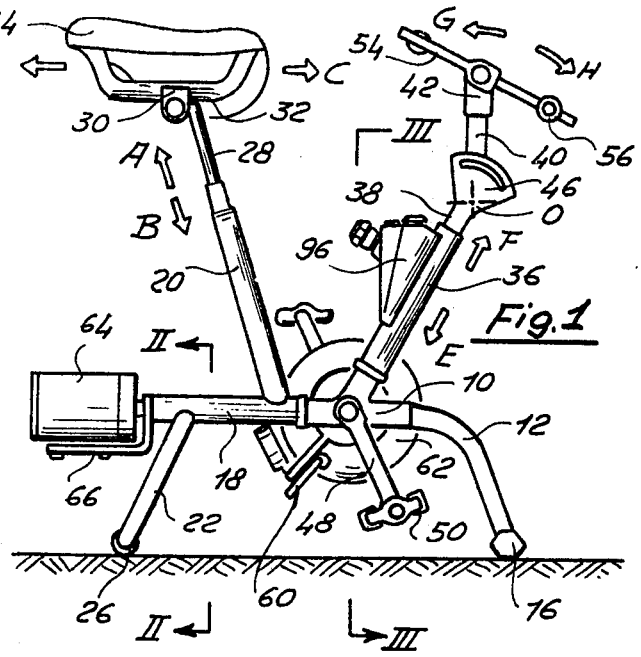
FIG. 1 is a somewhat diagrammatical side elevational view of a preferred embodiment of the invention.

An upper tubular member 40 is hingedly secured to the upper end of said inner post 38 about a transverse horizontal axis the trace of which is indicated at 0 in FIG. 1. The said upper end of post 38 is shaped to form a fork 46 about the lower end portion of the tubular member 40, and screw clamp means 44 (diagrammatically shown in FIG. 3) are provided for securing said upper member 40 to the post 38 in any desired adjustment position in either directions G and H about the hinge axis at O. A body 42 housing an upper second mechanical subassembly including the axle 58 of the handles, is fixedly secured to the upper end of the upper member 40.

The said crank handle axis position can therefore be either horizontally and vertically adjusted, independently of the either vertical and horizontal adjustment of the seat position. While the vertical and the horizontal adjustments of the seat and of the crank handle axis concur in the adjustments of the relative levels of and respectively of the horizontal interval between the seat and the handles locations, the complete independency of said adjustments from each other has been proved as being of paramount importance in view of the adaptation of the apparatus both to differently tall and built patients and to different requirements of physiotherapeutical exercises. As a matter of fact, it has been found and experienced that different muscular, ligaments and articular diseases, nervous and paresis phenomena and other physical disabilities might require widely different body attitudes for the most proper treatment. For example, different limbs extensions, knees and elbows bending, spine and ilia bending and attitude, and so on, might be selected by the therapist for the best treatment. The above described structure provides the desired independently adjustable features.

Figure 4:
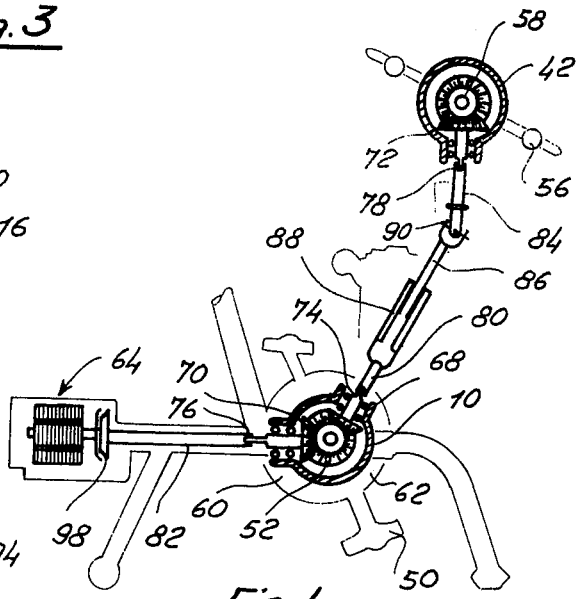
FIG. 4 is a somewhat simplified vertical sectional view of the transmission means included in the apparatus of FIG. 1.
Figure 5:
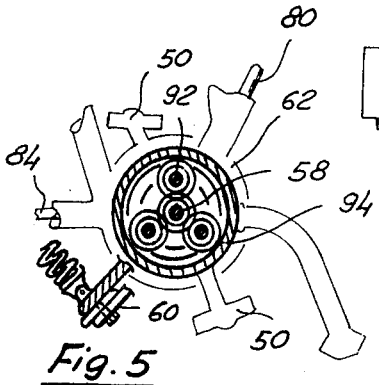
FIG. 5 is a detail of a gear mechanism associated to said transmission means for improving the rotary inertia of the rotating parts, as a whole, and therefore uniformizing the rotary motion thereof.

For concurrent and coordinate motion of the limbs, the pedal axle and the handle axle are rotatably connected to each other. For active and for passive exercising, both such axles are connected to a braking system and respectively to motor means. Additionally, the rotating components are preferably connected to flywheel means adapted to provide a convenient inertia for providing an essential uniform rotation upon the somewhat pulsing force applied by the feet and the hands of the patient during active exercising. FIGS. 4 and 5 diagrammatically illustrate preferred means provided therefor.

A rotating component, preferably the pedal axle, is connected to a sufficiently heavy flywheel 62 which also can be made use of as a component of the braking system. For example, a suitable bicycle-type brake 60 is provided for applying an adjustable frictional pressure at both flanks of the rim of said flywheel 62. Preferably, a gear train is connected to said flywheel for causing the same to rotate faster than the pedals to improve its inertia. An epicyclic train as diagrammatically illustrated in FIG. 5, including planet wheels 92, 94 and an internal gear 58, can be advantageously made use of for positioning the flywheel co-axially to the pedal axle, if desired. Such flywheel and braking means are operative when active exercises are performed.

Passive exercises require a source of rotary power for driving at the required speed the pedals and the handles. Such source preferably consists of an electric variable speed motor 64 supported to the frame assembly co-axially to the rear brace 18, by means of a bracket 66 (FIG. 1). A clutch 98 (FIG. 4) is provided for disconnecting the motor from the other rotary elements when not in use. On the other hand, such motor can be made use of as a braking system, by switching it for acting as a generator, a resistor (not shown) or other electrical energy absorbing means being made use of in such occurrence for dissipating the output. This modified embodiment of the braking system is particularly adapted for carefully executed physiotherapeutical treatments, because it can be associated with display or recording means which can indicate or record the duration of the exercise, the rotational speed and the energy output provided by the patient, as well as a curve of the output as a function of the time, upon conventional readings or recording of electrical values, as well known in the art.

The rotative interconnection of the pedals and handles axles and the motor is preferably provided by a mechanical transmission of the type diagrammatically illustrated in FIG. 4, including components anyone of which is supported by and protected within the components of the frame assembly. A critical feature of such transmission consists of its ability to provide the mechanical link in any relative position of said pedals and handles axles, and to do not prevent or disturb the adjustments made to said relative positions, that is to the relative position of the two mechanical subassemblies including the said pedals axle and respectively the said handles axle.

The first subassembly is housed in the said central body 10 and includes the pedals axle keyed to a bevel gear 52 in mesh with two bevel gears 70 connected at 74 and 76 with a shaft 80 housed within the stationary tube 36 (compare FIGS. 1 and 4) and respectively with a shaft 82 connected to motor 64, more particularly with the driven component of the clutch 98. The second subassembly is housed within the body 42 at the upper end of the adjustingly swingable member 40 and includes the handles axle connected, by bevel gears 72 and a coupling 78, to a shaft 84 housed in said member 40. Said latter shaft 84 is connected, by means of an universal joint 90 in the hinge axis O (FIG. 1) with a shaft 86 housed in the inner post 38, so that the transmission can adapt itself to the adjustments made in directions G and H about the hinge axis at O. The shaft 86 is at its turn connected to the shaft 80 by means of an axial slip coupling 88 to compensate for the axial adjustments in directions E and F made by axially moving the post 38 within the stationary tube 36.

The couplings at 74, 76 and 78 are provided for rotatively connecting shafts supported within the housings of the mechanical subassemblies to shafts housed within tubular members appertaining to the frame structure or assembly. This not critical feature is however very advantageous because such couplings, preferably formed by diametral pins, can provide a noticeable clearance or play between the joined shafts. As a matter of fact, the shafts supported within the said housings are keyed to or made integral with bevel gears and consequently are precision mounted within ball bearings or equivalent bearing means, while the general structure of the frame assembly is of generally bicycle-type construction and cannot provide the most precise co-axiality. The simple provision of such couplings or joints at 74, 76, 78 has provided for a simpler manufacture and assembling of the apparatus, comprising a frame mostly made of welded tubular members adapted to be produced by usual bicycle industry methods and tooling, and separately constructed mechanical subassemblies produced by applying the current precision machining and methods typical of the gear boxes art.

The apparatus can be obviously complemented with various control and measurement devices, such as resistance and/or rotary speed meters, and with knobs or other means for adjusting the braking force actually applied to the actively applied muscular force, the speed of motor 64 and so on. Such means can be suitably housed in an enclosure 96 secured to the stationary tube 36 and having an instrument board formed at its face turned towards the exerciser.

I claim:

1. An apparatus for the active and passive exercising of a user, comprising a bicycle frame assembly including a seat and a forward and a rear upstanding tubular component, said frame being selfstanding and having a vertical plane; a pair of crank pedals on said frame in a lower region thereof and rotatable about a horizontal first axis, said crank pedals including means for braking their rotation; a pair of crank handles on said frame spaced upwardly of said crank pedals and being rotatable about a horizontal second axis which is in substantial parallelism with said first axis; means for independently adjusting the vertical and horizontal relative orientation of said seat and said crank handles with respect to said crank pedals so as to determine the body attitude of a user positioned on said seat, said adjusting means including forward and rear tubular members respectively connected with said crank handles and said seat and being respectively slidingly received within said forward and rear tubular components of said frame for respectively adjusting the vertical and horizontal position of said crank handles and said seat in said vertical plane, and pivotable members mounted on said forward and rear tubular members operative for respectively adjusting the horizontal orientation of said crank handles and said seat; means for driving said crank handles and said crank pedals for passively exercising a user, said means for driving including a power unit, first means for rotatably connecting said power unit, said crank handles and said crank pedals with each other, and second means for permitting universal movement of said crank pedals with respect to said crank handles, said second means including a universal joint; and means for selectively decoupling said power unit and said crank pedals for actively exercising a user.

2. An exercising apparatus as defined in claim 1, wherein said frame assembly comprises a lower stationary rigid portion including means for supporting the apparatus on the ground, a central body having a first mechanical sub-assembly comprising an axle for said crank pedals; and wherein said forward and rear tubular members comprise a pair of independently first and second upwardly-extending portions respectively supporting said crank handles and said seat at their upper end portions, said first and second upwardly-extending portions each respectively cooperating with said forward and rear tubular components which are fixedly secured to said lower rigid portion and each respectively comprising a first component adjustably secured to said forward and rear tubular components for adjustment in an essentially vertical direction and a second component adjustably secured to said first components for adjustment in an essentially horizontal direction in said vertical plane.

3. An exercising apparatus as claimed in claim 2, wherein said second component of said first upwardly-extending portion which supports said crank handles is hingedly connected to its adjacently-associated first component for swinging adjustment about a transverse horizontal axis.

4. An exercising apparatus as claimed in claim 3, wherein said first means further comprises an upper shaft and an intermediate shaft, said upper and intermediate shafts being respectively mounted for rotation in said second and said first components of said first upwardly-extending portion which supports said crank handles; and wherein said universal joint has joint axes concurring in said transverse horizontal hinge axis to rotatably connect said upper shaft to said intermediate shaft of said first means.

5. An exercising apparatus as claimed in claim 4, wherein said first component of said first upwardly-extending portion which supports said crank handles is telescopingly received within said forward tubular component in a predetermined direction, and wherein said first means also comprises a lower shaft supported in said first component of said first upwardly-extending portion, said lower and intermediate shafts being elongated in the direction of said predetermined direction, and wherein said second means for permitting universal movement comprises an axial slip joint operative for rotatably connecting said lower and intermediate shafts mounted in said first component of said first upwardly-extending portion to each other in the direction of their common elongation.

6. An exercising apparatus as claimed in claim 1; and further comprising a flywheel having substantial inertia and a gear train connecting said flywheel to said first means, said train being geared for rotating said flywheel at a rotational speed higher than that of said crank pedals and said crank handles.

7. An exercising apparatus as claimed in claim 1, wherein said power unit is a variable speed electric motor drivingly connected with said first means for passive exercising, said motor being operative to generate an electrical output when driven by a user during active physiological exercising.

8. An apparatus for either active and passive physiological exercising of the limbs and essentially the entire body of a user, comprising a generally bicycle-type frame assembly having a vertical longitudinal plane of symmetry and forming a stand for supporting a seat; a pair of crank pedals and a pair of crank handles, both of which are supported for rotation about respective horizontal axes, said seat and axes defining in said plane three spaced locations concurring to determine the body attitude of a user; mechanical transmission means for rotatably connecting said crank pedals and said crank handles to each other, said transmission means being connected between said crank handles and said crank pedals, said frame assembly including longitudinally slidably fitted and hingedly connected components to support said seat and said crank handles for independent vertical and longitudinal adjustment in said plane of the locations of said seat and said crank handles relative to said crank pedals, said transmission means including means generally intermediate the connection to said crank pedals and to said crank handles for permitting universal movement of the part of the transmission means connected to said crank pedals with respect to the part of the transmission means connected to said crank handles, said transmission means including a universal joint; and a motor and braking means alternatively and selectively connected to said transmission means for permitting, respectively, passive and active exercising by a user.

* * * * *